United States Patent [19]

Graham

[11] 4,407,175

[45] Oct. 4, 1983

[54] TOOL FOR ROTATING THREADED FASTENERS

[76] Inventor: Douglas I. Graham, 86 Yew Tree Dr., Guildford, Surrey, England, GU1 1NZ

[21] Appl. No.: 298,909

[22] Filed: Sep. 2, 1981

[51] Int. Cl.[3] ..... B25B 13/46

[52] U.S. Cl. ..... 81/57.39; 81/57.46; 81/58.1; 81/59.1

[58] Field of Search ..... 81/57.39, 57.46, 58.1, 81/59.1, 57.27, 60, 61

[56] References Cited

U.S. PATENT DOCUMENTS

| | | | |
|---|---|---|---|
| 870,014 | 11/1907 | Campbell | 81/59.1 |
| 1,105,854 | 8/1914 | Shriver | 81/60 |
| 2,365,839 | 12/1944 | Pike | 81/58.1 |
| 2,487,987 | 11/1949 | Schmitt et al. | 81/59.1 |
| 2,690,689 | 10/1954 | Batcha | 81/57.46 |
| 3,572,188 | 3/1971 | Christian | 81/57.46 |
| 4,099,430 | 7/1973 | Stodola | 81/59.1 |

*Primary Examiner*—James L. Jones, Jr.
*Attorney, Agent, or Firm*—Sherman & Shalloway

[57] ABSTRACT

A tool for rotating a threaded fastener comprises a wrench head, a drum mounted therein and rotable by pulling on a ring attached to the free end of steel tape wound therearound to rotate a loose fastener rapidly, the rotary drive being imparted through a free-wheel mechanism and an output shaft on the end of which is carried a conventional socket. Return motion of the drum is effected by a coil spring. Final tightening or initial loosening of the fastener is accomplished by pulling on the handle of a ratchet wrench handle located on the head by a U-pin.

Alternatively the head incorporates a wrench handle and is arranged to drive the output shaft through a ratchet mechanism: the free-wheel mechanism comprises an axially-reciprocable, spring-loaded plunger mounted on the drum co-operating with engagement means mounted on the output shaft.

6 Claims, 5 Drawing Figures

TOOL FOR ROTATING THREADED FASTENERS

BACKGROUND OF THE INVENTION (1) Field of the Invention

This invention relates to a tool for rotating a threaded fastener comprising a wrench head, a drive member arranged for rotation therein and for direct or indirect engagement with the fastener, an elongate member reciprocally mounted in the head and arranged such that movement thereof in one direction causes rotation of the drive member to enable the fastener to be rotated quickly with low torque and locking means for locking the head to the drive member to allow a high torque to be applied thereto through a relatively small angle for final tightening or initial loosening of the fastener.

(2) Description of the Prior Art

Two-speed wrenches make it possible to rotate the rotatable member of a threaded fastener, such as a nut, bolt or screw, at a relatively high speed when loose, and for a high torque to be applied through a small angle for the final tightening or for starting a fastener which is to be undone. The simplest form of two-speed tool is a pivotal handle which can be used with the two parts aligned in order to rotate loose fasteners, rather in the manner of a screw-driver, and with the parts at right angles to apply a high torque. A two-speed ratchet wrench is known from U.S. Pat. No 735,134 in which the inner end of the elongate member is engageable with ratchet teeth on the drive member and is manually reciprocable by means of an integral finger extending outside the wrench head and terminating in a knob which is grasped by the operator. Such an arrangement is fiddly to use and demands a great number of manual movements to rotate the fastener through a few revolutions. In the preferred embodiment described in this U.S. Specification the rotation of the drive member independently of the wrench head for the relatively high-speed rotation of loose fasteners is effected by the rotation of a shaft journalled longitudinally in the wrench handle and having at its inner end a pinion engaging gear teeth formed on the drive member, and at its outer end a handle for rotating the shaft, which is axially slidable so as to be used in the normal way for final tightening or initial loosening of the fastener.

More sophisticated forms of this type of two-speed ratchet wrench are disclosed in U.S. Pat. No 2,703,030 in which, in some embodiments, the shaft is axially slidable so as to disengage the gears; and in UK No 2,004,794 in which the axial movement of the shaft is additionally utilised to move the ratchet pawl between two engagement positions for drive in opposite senses and a central, disengaged position. However all these wrenches require the turning of a rather small handle at the distal end of the wrench handle itself which is a somewhat fiddly, and often inconvenient, operation. The above mentioned U.S. No 2,703,030 and UK No 300,713 disclose the use of a power source to rotate the shaft.

The development of two-speed wrenches has thus been in the direction of effecting high speed rotation by providing a shaft in the handle which demands either fiddly manual rotation or expensive powered rotation.

SUMMARY OF THE INVENTION

The present invention solves the problem of how to rotate the drive member at a relatively high speed in one simple movement by forming the drive member as a drum or providing it with a reel around which a non-resilient flexible member such as a wire, cable, cord or tape is wound. A simple pull exerted on the end of the flexible member causes rapid rotation of the drive member. Return motion of the drive member is achieved by resilient means such as a coil spring wound on another reel provided on the drive member or by using a flexible member, which is also resilient, viz. a spring.

BRIEF DESCRIPTION OF THE DRAWINGS

In the Figures the same or similar parts are indicated by like reference numbers.

DESCRIPTION OF THE PREFERRED EMBODIMENTS

As the tool according to the present invention does not have to be provided with an integral handle it allows any conventional handle to be used, for example a simple handle of desired length, a ratchet handle or a torque wrench handle. On the other hand the wrench head according to the present invention may be formed with an integral handle and incorporate a ratchet mechanism; in this case an auxiliary handle may optionally be used on the end of a double-ended output shaft opposite that end engaging the fastener. Furthermore, the use of a double-ended output shaft enables the wrench to be reversed and thus dispenses with the need for a switchable ratchet pawl.

DETAILED DESCRIPTION OF THE INVENTION

Two embodiments of the present invention will now be described, by way of example, with reference to the accompanying drawings.

Figure 3:
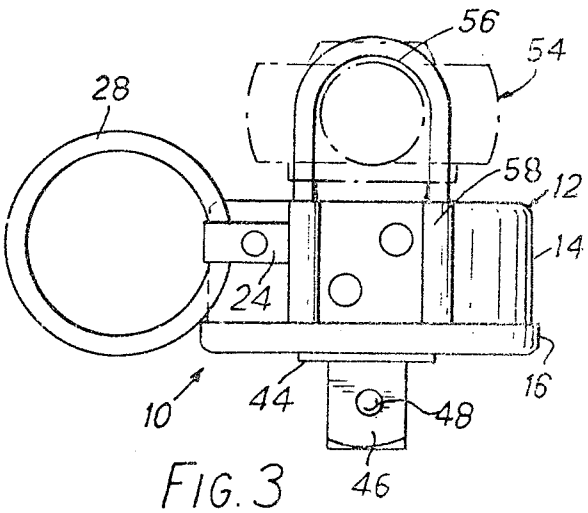
FIG. 3 is an elevation of the head of FIGS. 1 and 2 taken at right angles to the elevation of FIG. 1.
Figure 1:
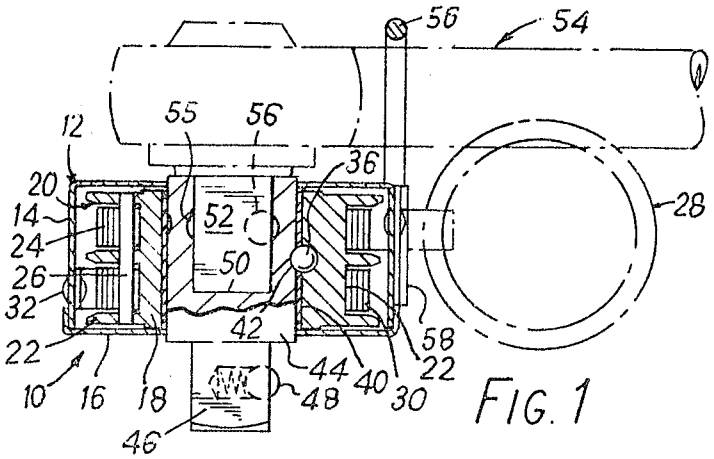
FIG. 1 is an elevation in partial, axial section of a wrench head according to one embodiment of the invention.
Figure 2:
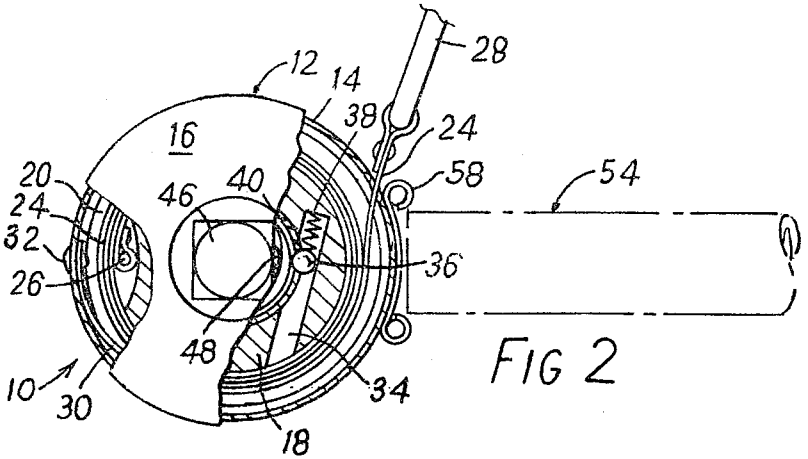
FIG. 2 is an underside plan of the head of FIG. 1 partly broken away and in partial vertical section.

As shown in FIGS. 1 to 3 a tool 10 for turning a nut or bolt comprises a wrench head 12 formed by an upper annular casing 14 and a bottom plate 16 and having mounted for rotation therein an annular drum 18 constituting a drive member and provided with an integral upper reel 20 and a lower reel 22. Around the upper reel 20 is wound a steel tape 24, the inner end of which is anchored to a pillar 26 accommodated in a circumferential cutout in the reels 20, 22 and the outer end of which projects through an aperture in the casing 14 and terminates in a ring 28. Around the lower reel 22 is wound a coil spring 30, the inner end of which is anchored to the lower part of the pillar 26, and the outer end to the casing 14 by a rivet 32.

The drum 18 is provided with a skew bore 34 in which is received a ball 36 loaded by a spring 38 and retained in position by a sleeve 40 which is an interference fit in the axial bore in the drum 18 and has an orifice which allows a segment of the ball 36 to project into an arcuate-section groove 42 running around a stub shaft 44 constituting an output shaft which is rotatable within the sleeve 40.

The stub shaft 44 has at its lower end an integral square drive key 46 having a conventionally spring-pressed ball 48 to retain thereon a standard socket member (not shown) and in its upper end a square section well 50 to receive a shaft 52 of a conventional ratchet-wrench 54 (shown in chain-dotted line), the walls of the well 50 being provided with shallow depressions 55 to accommodate a spring-pressed ball 56 on the wrench shaft 52. The handle of the wrench 54 is retained by means of a U-pin 56, the ends of which are received in a double-ended clip 58 mounted on the wall of the annular casing 14.

To do up a nut the tool 10 is used with the wrench 54 and wrench head 12 located in relation to the stub shaft 44 as shown in FIGS. 1 to 3, with an appropriate socket being fitted on the drive key 46. After placing the socket over the nut the handle 54 is held in one hand and the ring 28 pulled with the other to cause rotation of the drum 22 in a clockwise direction. This causes the ball 36 to wedge in the groove 42 and the stub shaft 44 to be rotated by the drum 18 and thus revolve the nut rapidly to run it down until it abuts the surface against which it is to be tightened. The ring 28 is then released allowing the spring 30 to revolve the drum 18 in the opposite direction to return it to its initial position and to rewind the tape 24. This return motion is allowed by virtue of the manner in which the ball 36 sits in the bore 34 which allows it to skid in the groove during rotation in the opposite direction. It will thus be appreciated that the spring-loaded ball 36 acts both as a free-wheel mechanism and a ball-detent to hold the stub shaft 44 in position.

Final tightening of the nut is achieved by means of the ratchet wrench 54 which drives the nut directly through the stub shaft 44 and the socket.

To undo a nut the U-pin 56 is removed from the clip 58 and the wrench 54 from the head 12. After reversal of the stub shaft 44 within the head 12 the wrench 54 is replaced and the clip 58 re-inserted. To start the nut the handle of the wrench is operated in the normal way and when the nut is loose it is run up by pulling on the ring 28.

Figure 4:
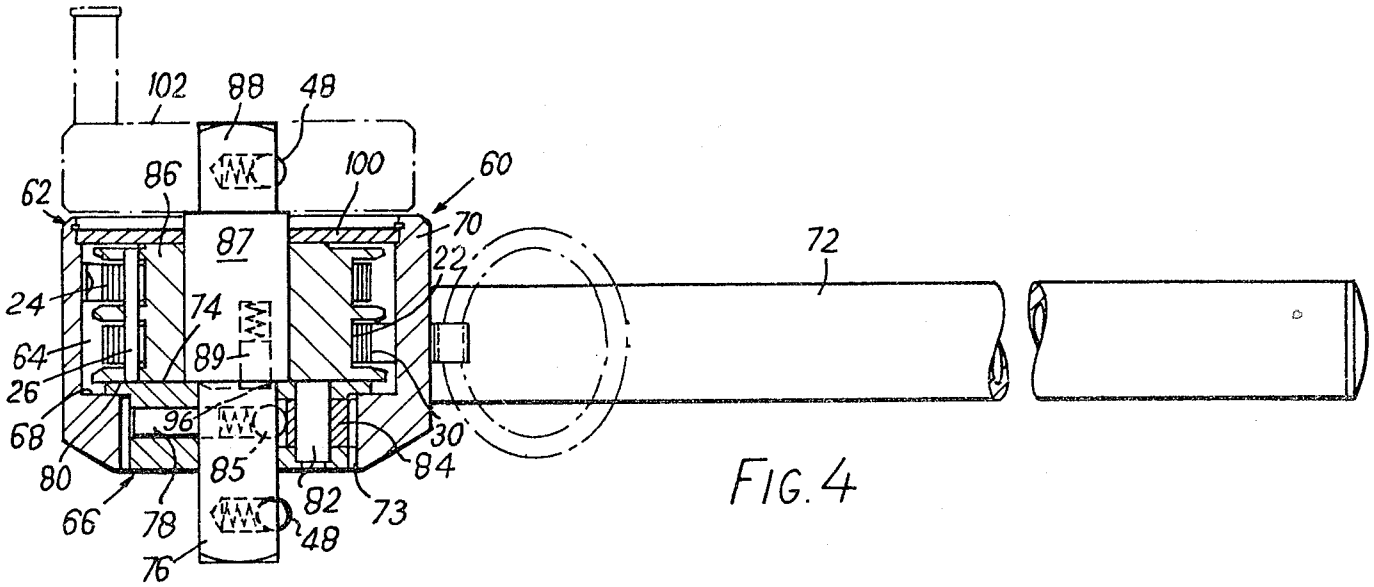
FIG. 4 is a side elevation of a wrench according to another embodiment of the invention with parts shown in axial section.
Figure 5:
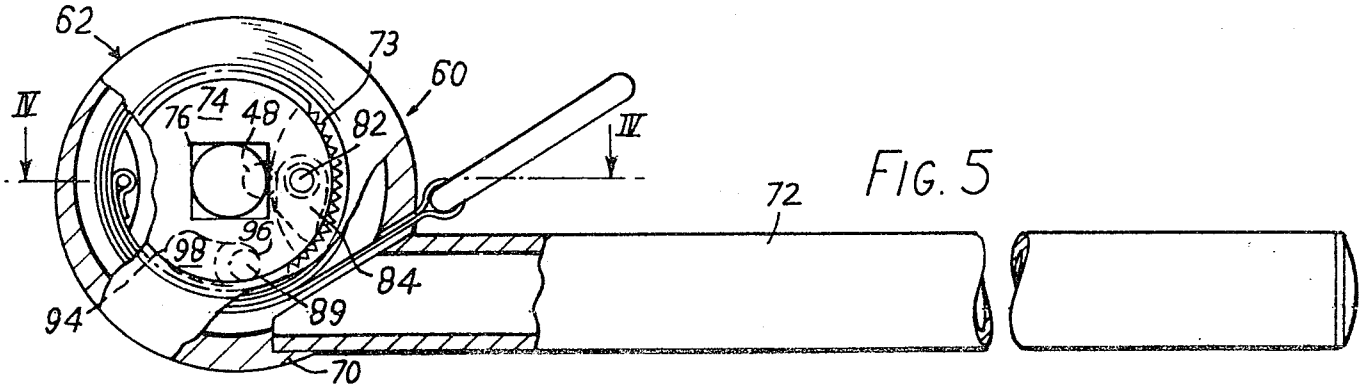
FIG. 5 is an underside plan of the wrench of FIG. 4, partly broken away.

In FIGS. 4 and 5 there is shown a ratchet wrench 60 having a circular head 62 which has an eccentric annular cavity 64 in the top part thereof extending into a smaller diameter cavity 66 at the base so as to form a shoulder 68; inserted into an orifice in the thickest portion of the annular wall 70 of the head 62 is a tubular wrench handle 72 and teeth 73 project internally from the wall of the cavity 66.

A pawl plate 74 is mounted on a square-section drive shaft 76 and retained by pin 78. The pawl plate 74 has a flange 80 which rests on the shoulder 68. In a circumferential slot in the pawl plate 74 there is secured a pillar 82 on which is pivotally mounted a pawl 84 biased against the teeth 73 by a spring-loaded ball 85 received in a bore in the shaft 76.

A drum 86 is rotatably mounted above the pawl plate 74 and is identical with the drum 18 apart from having a narrower central bore and lacking the skew bore 34. The tape 24 and other parts associated with the drum 18 are as previously described. Received in the central bore of the drum 86 is a stub shaft 87 integral with the shaft 76 and which terminates in a drive key 88. The drum 86 has a spring-loaded plunger 89 received in an axially-offset bore in its lower end. The plunger 89 is urged into an arcuate recess 94 formed in the top of the plate 74 and providing an abutment surface 96 and a ramp 98. The top of the cavity 64 is closed by a cover plate 100.

The wrench 60 is operated to screw or unscrew a nut in essentially the same way as the tool 10. A pull on the ring 28 rotates the drum 86 which causes the plunger 89 to rotate the plate 74 by virtue of its engagement with the axially-extending abutment surface 96; the pawl 84 rides over the teeth 73 when the shaft 76 and associated pawl plate 74 are rotated in this sense (anti-clock wise as seen in FIG. 5). During movement of the drum 86 in the opposite sense under the action of the spring 30 the plunger rides up the ramp 98 of the recess 94 and thus does not impede rotation of the drum 86 relatively to the pawl plate 74.

Final tightening or initial loosening of the nut is effected by a pull on the wrench handle 72, movement in the anti-clockwise direction (as seen in FIG. 5) transmitting the rotation to the shaft 76 by engagement of the pawl 84 with the teeth 73 and movement in the clockwise direction being free movement in a conventional ratchet action.

Rotation of the nut in the reverse sense whether by rotation of the drum 86 or operation of the wrench handle 72 is achieved simply by reversing the wrench 60 on the nut with of course transfer of the socket to the opposite end of the shaft 87.

Direct rotation of the shaft 87 may optionally be effected by the use of an auxiliary handle 102, on the drive key 88 in the arrangement shown in FIGS. 4 and 5 (or on the shaft 76 if the drive key 88 is engaging the nut).

What is claimed is:

1. A wrench head for use with a rachet-wrench for rotating a fastener, said rachet-wrench including an elongated handle, a rachet mechanism attached to said handle and a key-like shaft depending from said rachet mechanism, said wrench head comprising:

(a) housing means;

(b) rotatable drum means located in said housing means;

(c) a flexible member normally wound around said drum means and including a first end fixed to said drum means and a second end extending through an opening in said housing means, pulling of said second end causing rotation of said drum means;

(d) a resilient means connected between said drum means and said housing means to resiliently resist said pulling of said second end of said flexible member;

(e) said rotatable drum means including an opening formed therein;

(f) a stub shaft means removably placed in said drum means opening;

(g) means carried by said drum means for releasably retaining said stub shaft means in said drum means opening, said releasably retaining means also allowing rotation of said drum means with respect to said stub shaft means in a first direction and preventing such rotation in a second direction;

(h) receptacle means formed in one end of said stub shaft means which releasably receives said key-like shaft of said rachet-wrench;

(i) key means depending from the other end of said stub shaft means which fixedly engages a receptacle formed in a standard socket member; and (j) means on said housing means which releasably retains said elongated handle of said rachet-wrench in a fixed orientation with respect to said wrench head.

2. The invention of claim 1 wherein said resilient means comprises a spring wound about said drum means in a position on said drum means spaced axially from the position wherein said flexible member is wound on said drum.

3. The invention of claim 1 wherein said flexible member comprises an elongated tape.

4. The invention of claim 1 wherein said means for releasably retaining said stub shaft means comprises a spring biased ball located in a skew bore in said drum means, said ball engaging, in assembly, a groove formed in an outer wall of said stub shaft means.

5. The invention of claim 1 wherein the means which releasably retains said elongated handle in a fixed orientation with respect to said wrench head comprises:

(a) a double ended clip mounted on an outer wall of said housing, said clip including a pair of receptacles, one at each end thereof; and (b) a U-shaped pin with two ends, each such end, in assembly, being releasably retained in a respective receptacle of said clip, said pin being sized so as to closely surround said elongated handle when said pin is retained in said clip receptacles to thereby fix the orientation of said elongated handle with respect to said housing.

6. The invention of claim 1 wherein said stub shaft means may be placed in said drum means opening in either one of two possible orientations, a first orientation providing rotation of said fastener in a first direction and a second orientation providing rotation of said fastener in a second direction opposite to said first direction.

* * * * *

UNITED STATES PATENT AND TRADEMARK OFFICE

CERTIFICATE OF CORRECTION

PATENT NO. : 4,407,175

DATED : October 4, 1983

INVENTOR(S) : Douglas I. Graham

It is certified that error appears in the above-identified patent and that said Letters Patent is hereby corrected as shown below:

On the title page insert:

-- [30] Foreign Application Priority Data

September 8, 1980 (GB) United Kingdom...8028907 --.

Signed and Sealed this

Twentieth Day of December 1983

[SEAL]

Attest:

GERALD J. MOSSINGHOFF

Attesting Officer

Commissioner of Patents and Trademarks